US010437186B2

(12) United States Patent
Tamura

(10) Patent No.: US 10,437,186 B2
(45) Date of Patent: Oct. 8, 2019

(54) FIXING DEVICE AND IMAGE FORMING APPARATUS

(71) Applicant: Konica Minolta, Inc., Tokyo (JP)

(72) Inventor: Nobuyasu Tamura, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/152,817

(22) Filed: Oct. 5, 2018

(65) Prior Publication Data

US 2019/0121263 A1 Apr. 25, 2019

(30) Foreign Application Priority Data

Oct. 20, 2017 (JP) ..... 2017-203889

(51) Int. Cl.
*G03G 15/20* (2006.01)
*G03G 15/00* (2006.01)

(52) U.S. Cl.
CPC ..... *G03G 15/205* (2013.01); *G03G 15/70* (2013.01)

(58) Field of Classification Search
CPC .. G03G 15/2028; G03G 15/70; G03G 15/706; G03G 15/205; G03G 2215/00548
See application file for complete search history.

(56) References Cited

U.S. PATENT DOCUMENTS

2017/0199489 A1* 7/2017 Shimomura ..... G03G 15/2053

FOREIGN PATENT DOCUMENTS

JP 2014167618 A 9/2014

* cited by examiner

*Primary Examiner* — Sandra Brase
(74) *Attorney, Agent, or Firm* — Lucas & Mercanti, LLP

(57) ABSTRACT

A fixing device includes: a fixer that includes a heater controlled and lighted on the basis of a detection result of a temperature sensor, and melts and fixes an unfixed toner on a recording medium, using heat of when the heater is lighted; a lighting rate acquirer that acquires a first lighting rate of the heater after jam recovery and a second lighting rate of the heater before jam occurrence in a case where a jam of the recording medium occurs at a fixing nip position of the fixer; and a determiner that compares the first lighting rate with the second lighting rate, and determines whether the recording medium remains between the temperature sensor and the heater according to a result of the comparison.

13 Claims, 8 Drawing Sheets

FIG. 7

| TEMPERATURE SENSOR AMBIENT TEMPERATURE | CORRECTION COEFFICIENT OF LIGHTING RATE |
|---|---|
| LESS THAN 70°C | 0.88 |
| 70°C OR MORE AND LESS THAN 90°C | 0.92 |
| 90°C OR MORE AND LESS THAN 110°C | 0.96 |
| 110°C OR MORE | 1.00 |

FIG. 8

| | PLAIN PAPER | COATED PAPER |
|---|---|---|
| BASIS WEIGHT 1 | 1.00 | 1.20 |
| BASIS WEIGHT 2 | 1.30 | 1.56 |
| BASIS WEIGHT 3 | 1.50 | 1.80 |
| BASIS WEIGHT 4 | 1.70 | 2.04 |
| BASIS WEIGHT 5 | 1.90 | 2.28 |

FIG. 9

| | DURING STANDBY |
|---|---|
| TARGET TEMPERATURE 1 | 1.00 |
| TARGET TEMPERATURE 2 | 1.15 |
| TARGET TEMPERATURE 3 | 1.30 |
| TARGET TEMPERATURE 4 | 1.45 |
| TARGET TEMPERATURE 5 | 1.60 |

FIG. 10

| SHEET WIDTH | DETERMINATION CRITERION OF LIGHTING RATE RATIO |
|---|---|
| LESS THAN 148 mm | 2.0–3.5 |
| 148 mm OR MORE AND LESS THAN 210 mm | 1.3–2.2 |
| 210 mm OR MORE AND LESS THAN 257 mm | 1.1–1.9 |
| 257 mm OR MORE AND LESS THAN 297 mm | 0.9–1.55 |
| 297 mm OR MORE | 0.75–1.3 |

FIXING DEVICE AND IMAGE FORMING APPARATUS

The entire disclosure of Japanese patent Application No. 2017-203889, filed on Oct. 20, 2017, is incorporated herein by reference in its entirety.

BACKGROUND

Technological Field

The present invention relates to a fixing device and an image forming apparatus.

Description of the Related Art

Conventionally, as a fixing device used in an electrophotographic image forming apparatus such as a multifunction peripheral provided with a copier, a printer, and a facsimile, or having functions of the aforementioned devices in combination, a fixing device is known, which fixes an unfixed toner image on a sheet as a recording medium by heating and pressurizing the sheet at a fixing nip formed between a pair of heating roller and pressure roller pressed against each other and rotated while nipping and conveying the sheet by the pair of heating roller and pressure roller.

A heater as a heat source is provided inside the heating roller. A temperature sensor is provided to face the heating roller is provided outside the heating roller. Lighting of the heater is controlled so that the temperature of the heating roller is adjusted on the basis of a difference between a detection result (detected temperature) of the temperature sensor and a target temperature of the heating roller. Therefore, in a case where the temperature sensor is abnormal, lighting control of the heater is not appropriately performed, and as a result, the temperature of the heating roller cannot be adjusted in some cases.

There is known an image forming apparatus that determines that a temperature sensor is abnormal in a case where a time in which a calculated value of an energization amount per unit time with respect to a heater falls outside a predetermined range exceeds a specified time (for example, see JP 2014-167618 A).

By the way, in a case where a jam occurs in the fixing device, image formation is stopped, and the fixing device recovers from the jam after a jammed sheet is removed. In a case where a sheet (for example, a piece of paper) remains near the temperature sensor after jam recovery, for example, the sheet becomes an obstacle to the heater, and the temperature sensor detects a lower temperature than a detected temperature of a case where no sheet remains. As a result, lighting control of the heater based on the detection result of the temperature sensor may not be appropriately performed.

Note that the image forming apparatus described in JP 2014-167618 A has a problem in determining whether the temperature sensor is abnormal, and does not have a constitution to accurately determine whether a sheet remains after jam recovery.

SUMMARY

An object of the present invention is to provide a fixing device and an image forming apparatus capable of accurately determining whether a sheet remains after jam recovery.

To achieve the abovementioned object, according to an aspect of the present invention, a fixing device reflecting one aspect of the present invention comprises a fixer that includes a heater controlled and lighted on the basis of a detection result of a temperature sensor, and melts and fixes an unfixed toner on a recording medium, using heat of when the heater is lighted; a lighting rate acquirer that acquires a first lighting rate of the heater after jam recovery and a second lighting rate of the heater before jam occurrence in a case where a jam of the recording medium occurs at a fixing nip position of the fixer; and a determiner that compares the first lighting rate with the second lighting rate, and determines whether the recording medium remains between the temperature sensor and the heater according to a result of the comparison.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 7 is a diagram illustrating a correspondence between a temperature sensor ambient temperature and a correction coefficient of a lighting rate in a first modification;

FIG. 8 is a diagram illustrating a correspondence between a type of a sheet and a correction coefficient of a lighting rate in a second modification;

FIG. 9 is a diagram illustrating a correspondence between a target temperature of a fixing belt during standby and a correction coefficient of a lighting rate in a third modification;

FIG. 10 is a diagram illustrating a correspondence between a sheet width and a determination criterion of a lighting rate ratio in a fourth modification.

DETAILED DESCRIPTION OF EMBODIMENTS

Figure 1:
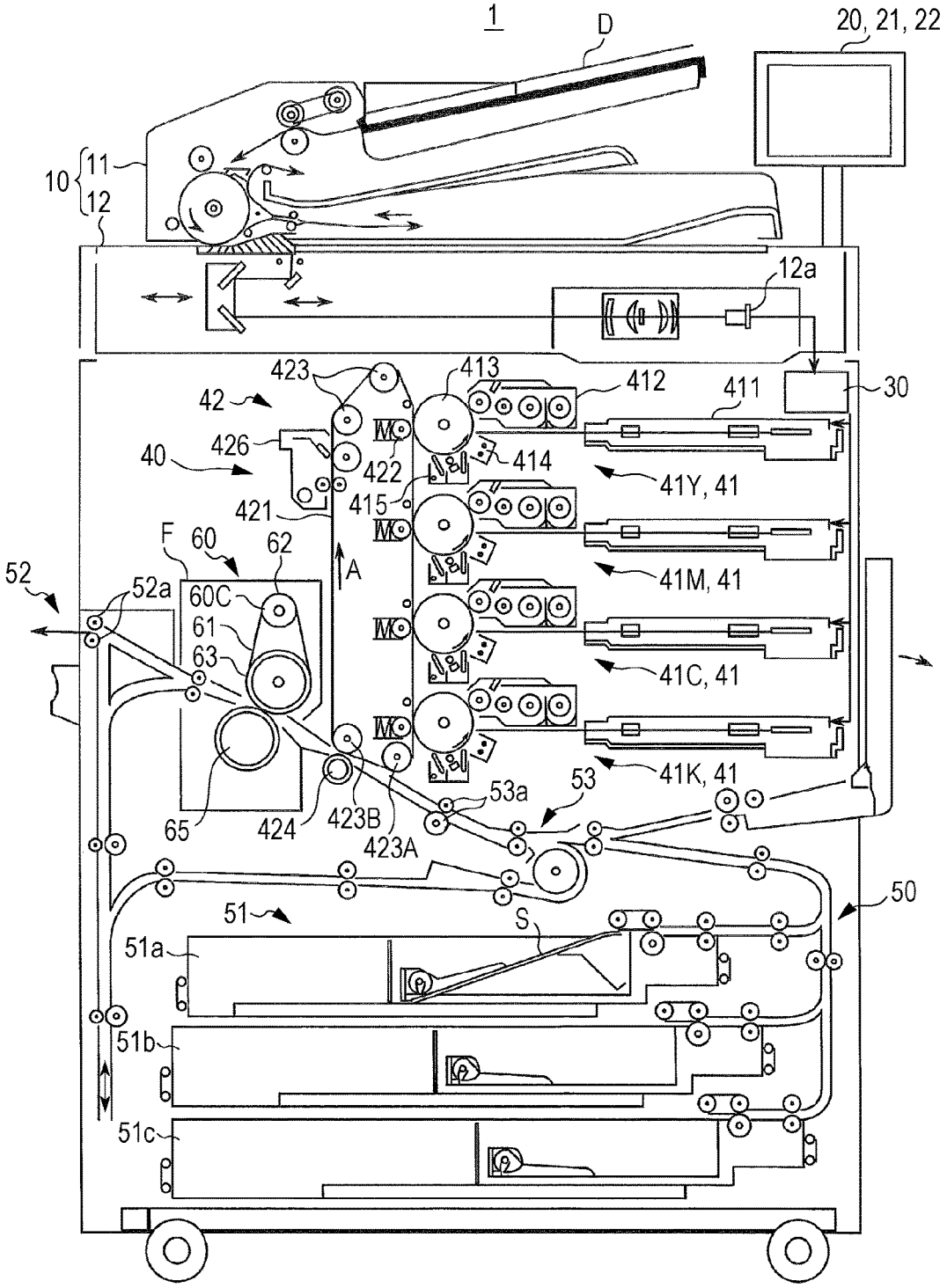
FIG. 1 is a diagram schematically illustrating an overall constitution of an image forming apparatus according to an embodiment of the present invention.
Figure 2:
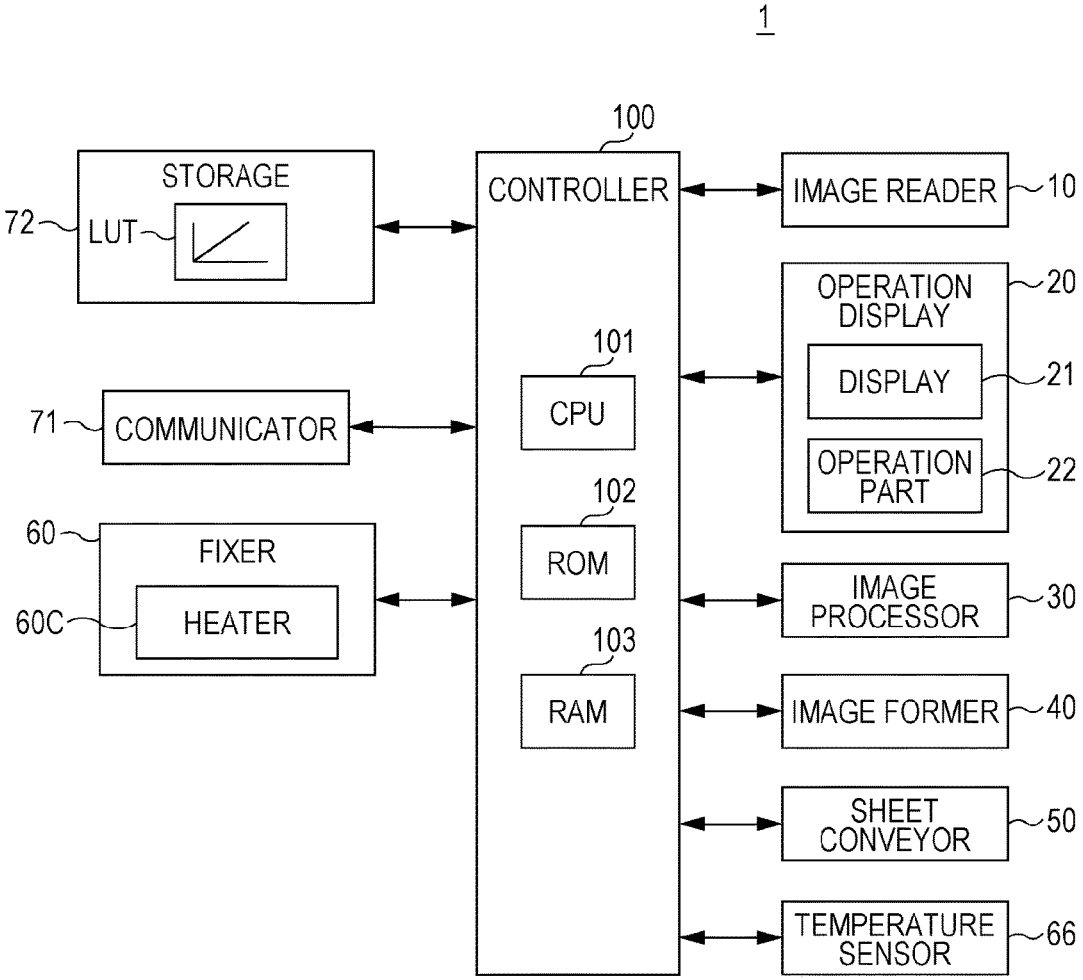
FIG. 2 is a diagram illustrating a main part of a control system of the image forming apparatus according to the present embodiment.

Hereinafter, one or more embodiments of the present invention will be described in detail with reference to the drawings. However, the scope of the invention is not limited to the disclosed embodiments. FIG. 1 schematically illustrates an overall constitution of an image forming apparatus 1 according to an embodiment of the present invention. FIG. 2 illustrates a main part of a control system of the image forming apparatus 1 according to the present embodiment. The image forming apparatus 1 illustrated in FIGS. 1 and 2 is an intermediate transfer-type color image forming apparatus using an electrophotographic process technology. That is, the image forming apparatus 1 forms an image by primarily transferring color toner images of yellow (Y), magenta (M), cyan (C), and black (K) formed on photosensitive drums 413 to an intermediate transfer belt 421, superimposing the four colors of toner images on the intermediate transfer belt 421, and then secondarily transferring the superimposed toner image on a sheet S (recording medium).

Further, a tandem system is adopted in the image forming apparatus 1, in which the photosensitive drums 413 corresponding to the YMCK four colors are arranged in series in a traveling direction of the intermediate transfer belt 421, and the color toner images are sequentially transferred onto the intermediate transfer belt 421 in a single procedure.

As illustrated in FIG. 2, the image forming apparatus 1 includes an image reader 10, an operation display 20, an image processor 30, an image former 40, a sheet conveyor 50, a fixer 60, and a controller 100.

The controller 100 includes a central processing unit (CPU) 101, a read only memory (ROM) 102, a random access memory (RAM) 103, and the like.

The CPU 101 reads a program corresponding to processing content from the ROM 102, develops the program in the RAM 103, and centrally controls operation of blocks of the image forming apparatus 1 in cooperation with the developed program. At this time, various data stored in a storage 72 is referred to. The storage 72 includes, for example, a nonvolatile semiconductor memory (so-called flash memory) or a hard disk drive.

The controller 100 transmits/receives various data to/from an external device (for example, a personal computer) connected to a communication network such as local area network (LAN) or a wide area network (WAN) via a communicator 71. The controller 100 receives, for example, image data (input image data) transmitted from the external device, and forms an image on the sheet S on the basis of the image data. The communicator 71 includes a communication control card such as a LAN card, for example.

The image reader 10 includes an automatic document feeding device 11 called auto document feeder (ADF), a document image scanning device 12 (scanner), and the like.

The automatic document feeding device 11 conveys a document D placed on a document tray by a conveyance mechanism and sends the document D to the document image scanning device 12. The automatic document feeding device 11 can continuously read images (including images on both sides) of a large number of documents D placed on the document tray at once.

The document image scanning device 12 optically scans the document conveyed on a contact glass from the automatic document feeding device 11 or the document placed on the contact glass, causes reflected light from the document to form an image on a light receiving surface of a charge coupled device (CCD) sensor 12*a*, and reads the document image. The image reader 10 generates input image data on the basis of a reading result by the document image scanning device 12. Predetermined image processing is applied to the input image data by the image processor 30.

The operation display 20 includes a liquid crystal display (LCD) with a touch panel, for example, and functions as a display 21 and an operation part 22. The display 21 displays various operation screens, image status display, operation status of each function, and the like according to a display control signal input from the controller 100. The operation part 22 includes various operation keys such as a numeric keypad and a start key, accepts various input operations by a user, and outputs an operation signal to the controller 100.

The image processor 30 includes a circuit that performs, for the input image data, digital image processing corresponding to initial setting or user setting, and the like. For example, the image processor 30 performs gradation correction on the basis of gradation correction data (a gradation correction table) under the control of the controller 100. Further, the image processor 30 applies various types of correction processing such as color correction and shading correction in addition to the gradation correction, compression processing, and the like to the input image data. The image former 40 is controlled on the basis of the image data for which the aforementioned processing has been applied.

The image former 40 includes image forming units 41Y, 41M, 41C, and 41K for forming images by color toners of a Y component, an M component, a C component, and a K component on the basis of the input image data, an intermediate transfer unit 42, and the like.

The image forming units 41Y, 41M, 41C, and 41K for the Y component, the M component, the C component, and the K component have similar constitutions. For convenience of illustration and description, common constituent elements are denoted by the same reference numeral, and when differentiating the constituent elements, Y, M, C, or K is added to the reference numeral. In FIG. 1, only the constituent elements of the image forming unit 41Y for the Y component are denoted by reference numerals, and the reference numerals of the constituent elements of the other image forming units 41M, 41C, and 41K are omitted.

The image forming unit 41 includes an exposure device 411, a developing device 412, the photosensitive drum 413, a charging device 414, a drum cleaning device 415, and the like.

The photosensitive drum 413 is a negatively charged organic photoconductor (OPC) having an undercoat layer (UCL), a charge generation layer (CGL), and a charge transport layer (CTL) sequentially laminated on a peripheral surface of a conductive cylindrical body (aluminum element tube) made of aluminum. The charge generation layer includes an organic semiconductor in which a charge generation material (for example, phthalocyanine pigment) is dispersed in a resin binder (for example, polycarbonate), and generates a pair of positive and negative charges by exposure of the exposure device 411. The charge transport layer is formed by dispersing a hole transporting material (electron donating nitrogen-containing compound) in a resin binder (for example, a polycarbonate resin), and transports the positive charge generated in the charge generation layer to a surface of the charge transport layer.

The controller 100 controls a drive current to be supplied to a drive motor (not illustrated) that rotates the photosensitive drum 413, whereby the photosensitive drum 413 is rotated at a constant peripheral speed.

The charging device 414 uniformly charges the surface of the photoconductive photosensitive drum 413 with negative polarity. The exposure device 411 includes, for example, a semiconductor laser, and irradiates the photosensitive drum 413 with laser light corresponding to the image of each color component. The surface charge (negative charge) of the photosensitive drum 413 is neutralized as the positive charge is generated in the charge generation layer of the photosensitive drum 413 and is transported to the surface of the charge transport layer. An electrostatic latent image of each color component is formed on the surface of the photosensitive drum 413 due to a potential difference from surroundings.

The developing device 412 is, for example, a two-component developing device, and attaches the toner of each color component to the surface of the photosensitive drum 413 to visualize the electrostatic latent image to forma toner image.

The drum cleaning device 415 includes a drum cleaning blade that is in sliding contact with the surface of the photosensitive drum 413, and the like, and removes a transfer residual toner remaining on the surface of the photosensitive drum 413 after primary transfer.

The intermediate transfer unit 42 includes the intermediate transfer belt 421, a primary transfer roller 422, a plurality of support rollers 423, a secondary transfer roller 424, a belt cleaning device 426, and the like.

The intermediate transfer belt 421 is constituted by an endless belt, and is stretched over the plurality of support rollers 423 in a loop manner. At least one of the plurality of support rollers 423 is constituted by a drive roller, and the others are constituted by driven rollers. For example, a roller 423A arranged on a downstream side in the belt traveling direction of the primary transfer roller 422 for the K component is favorably the drive roller. With the arrangement, the travel speed of the belt at the primary transfer part can be easily kept constant. The intermediate transfer belt 421 travels in an arrow A direction at a constant speed as the drive roller 423A rotates.

The primary transfer roller 422 is arranged on an inner peripheral surface side of the intermediate transfer belt 421, facing the photosensitive drum 413 of each color component. A primary transfer nip for transferring the toner image from the photosensitive drum 413 to the intermediate transfer belt 421 is formed as the primary transfer roller 422 is pressed against the photosensitive drum 413 across the intermediate transfer belt 421.

The secondary transfer roller 424 is arranged on an outer peripheral surface side of the intermediate transfer belt 421, facing a backup roller 423B arranged on a downstream side in the belt traveling direction of the drive roller 423A. A secondary transfer nip for transferring the toner image from the intermediate transfer belt 421 onto the sheet S is formed as the secondary transfer roller 424 is pressed against the backup roller 423B across the intermediate transfer belt 421.

The toner images on the photosensitive drums 413 are primarily transferred and sequentially superimposed onto the intermediate transfer belt 421 when the intermediate transfer belt 421 passes through the primary transfer nip. Specifically, a primary transfer bias is applied to the primary transfer roller 422, and a charge having an opposite polarity to the toner is imparted to a back surface side (a side in contact with the primary transfer roller 422) of the intermediate transfer belt 421, whereby the toner image is electrostatically transferred to the intermediate transfer belt 421.

Thereafter, the toner image on the intermediate transfer belt 421 is secondarily transferred to the sheet S when the sheet S passes through the secondary transfer nip. Specifically, a secondary transfer bias is applied to the secondary transfer roller 424, and a charge having an opposite polarity to the toner is imparted to a back surface side (a side in contact with the secondary transfer roller 424) of the sheet S, whereby the toner image is electrostatically transferred to the sheet S. The sheet S to which the toner image has been transferred is conveyed toward the fixer 60.

The belt cleaning device 426 has a belt cleaning blade that is in sliding contact with the surface of the intermediate transfer belt 421, and the like, and removes a transfer residual toner remaining on the surface of the intermediate transfer belt 421 after secondary transfer. Note that a constitution (so-called belt-type secondary transfer unit) in which a secondary transfer belt is stretched over a plurality of support rollers including a secondary transfer roller in a loop manner may be adopted in place of the secondary transfer roller 424.

The fixer 60 includes an upper pressure roller 63 arranged on the side of a fixing surface (the surface on which the toner image is formed) of the sheet S, a lower pressure roller 65 arranged on the side of a back surface (a surface opposite to the fixing surface) of the sheet S, a heating source 60C, and the like. A fixing nip that nips and conveys the sheet S is formed as the upper pressure roller 63 and the lower pressure roller 65 are pressed against each other.

The fixer 60 heats and pressurizes, at the fixing nip, the sheet S to which the toner image has been secondarily transferred and conveyed to fix the toner image on the sheet S. The fixer 60 is arranged as a unit in a fixing unit F. Details of the fixer 60 will be described below.

The sheet conveyor 50 includes a sheet feeder 51, a sheet discharger 52, a conveying path 53, and the like. The sheets S identified on the basis of a basis weight, a size, and the like are accommodated for each preset type in three feed tray units 51*a* to 51*c* constituting the sheet feeder 51. The conveying path 53 has a plurality of conveying roller pairs such as a resist roller pair 53*a*.

The sheets S accommodated in the feed tray units 51*a* to 51*c* are sent out sheet by sheet from an uppermost part and are conveyed to the image former 40 by the conveying path 53. At this time, inclination of the fed sheet S is corrected and conveyance timing is adjusted by a resist roller part in which the resist roller pair 53*a* is disposed. Then, in the image former 40, the toner image on the intermediate transfer belt 421 is secondarily and collectively transferred to one surface of the sheet S, and a fixing process is performed in the fixer 60. The sheet S on which the image has been formed is discharged to the outside of the apparatus by the sheet discharger 52 provided with discharge rollers 52*a*.

Figure 3:
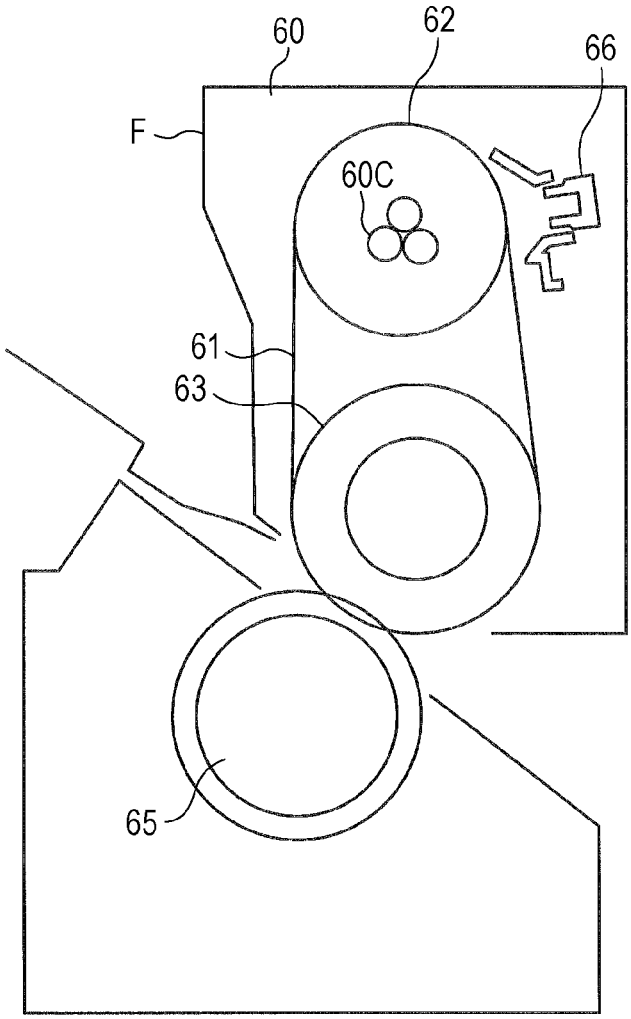
FIG. 3 is a diagram schematically illustrating a constitution of a fixer.

Next, a constitution of the fixer 60 will be described with reference to FIG. 3. FIG. 3 schematically illustrates a constitution of the fixer 60. In FIG. 3, the direction perpendicular to the sheet surface may be referred to as "width direction" or "axial direction". Note that the fixer 60 and the controller 100 function as a fixing device. The fixer 60 and the controller 100 may be constituted as a unit and attached to the image forming apparatus 1 or may be separately incorporated in the image forming apparatus 1 and function as the fixing device.

The fixer 60 includes an endless fixing belt 61, a heating roller 62, the upper pressure roller 63, and the lower pressure roller 65.

The fixing belt 61 is wound around the heating roller 62 and the upper pressure roller 63. The fixing belt 61 comes in contact with the sheet S on which the toner image is formed, and heats and fixes the toner image on the sheet S.

The heating roller 62 has the heating source 60C built in, which is, for example, a halogen heater (hereinafter simply referred to as "heater") for heating the fixing belt 61. In the heating roller 62, an outer peripheral surface in a cylindrical core metal formed of aluminum and the like is covered with a resin layer coated with PTFE. The heater 60C is lighted to heat the heating roller 62. As a result, the heating roller 62 heats the fixing belt 61.

Figure 4:
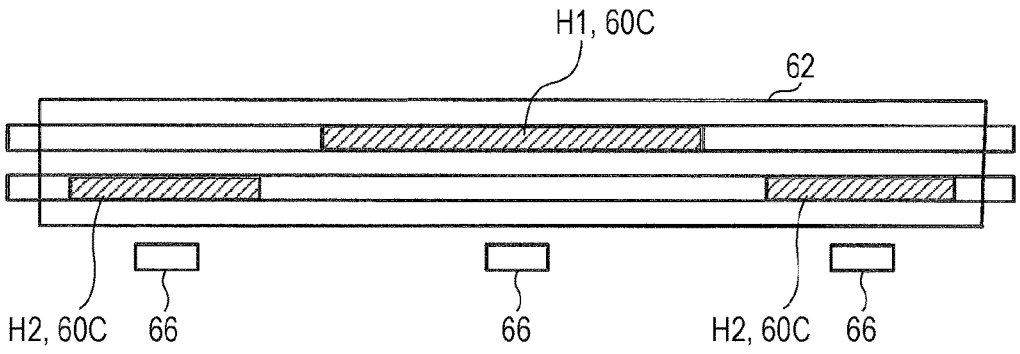
FIG. 4 is a diagram schematically illustrating an internal structure of a heating roller.

The heater 60C has a plurality of regions divided in the axial direction. Specifically, as illustrated in FIG. 4, the heater 60C includes a central heater H1 as a central region in the axial direction, and an end heater H2 as both end regions in the axial direction. A temperature sensor 66 is arranged facing the central heater H1. Further, a temperature sensor 66 is arranged facing the end heater H2. The central heater H1 is controlled and lighted on the basis of a detection result of the temperature sensor 66. Further, the end heater H2 is controlled and lighted on the basis of a detection result of the temperature sensor 66.

The lower pressure roller 65 is driven to rotate. The lower pressure roller 65 is pressed against the upper pressure roller 63 via the fixing belt 61. The sheet S is conveyed by drive force of the lower pressure roller 65 and drive force transmitted from the lower pressure roller 65 to the fixing belt 61.

As illustrated in FIG. 3, the temperature sensor 66 is arranged facing the heating roller 62 across the fixing belt 61. The temperature sensor 66 detects a surface temperature of the fixing belt 61. The controller 100 controls a power supply (not illustrated) for lighting the heater 60C so that the surface temperature of the fixing belt 61 is adjusted on the basis of a difference between the detection result of the temperature sensor 66 and a target temperature of the fixing belt 61. Therefore, a lighting rate of the heater 60C (a lighting period of the heater in a control cycle) becomes high according to the difference between the detection result of the temperature sensor 66 and the target temperature of the fixing belt 61. Here, the "target temperature" is a temperature preset according to a control state (for example, during standby or during printing) of the fixer 60. For example, the target temperature during standby of the fixer 60 is a temperature at which the fixer 60 can immediately transfer to printing. The target temperature during printing of the fixer 60 is a temperature suitable for fixing a toner image.

Figure 5:
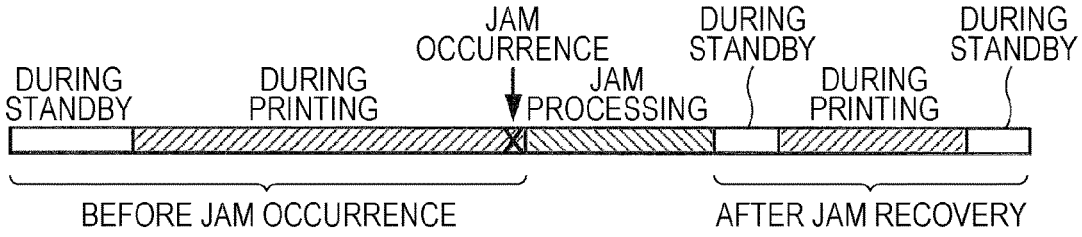
FIG. 5 is a diagram illustrating a control state of the fixer before and after jam occurrence.

A control state of the fixer 60 before and after jam occurrence will be described with reference to FIG. 5. FIG. 5 illustrates jam occurrence with "X", and illustrates "during standby" and "during printing" as control states of the fixer 60 before and after jam occurrence. In "during standby" and "during printing" in a case where no jam occurs in the fixer 60 and no sheet remains, the controller 100 controls and lights the heater 60C such that the surface temperature of the fixing belt 61 becomes the target temperature on the basis of the difference between the surface temperature of the fixing belt 61 detected by the temperature sensor 66 and the target temperature of the fixing belt 61.

On the other hand, in a case where a jam occurs in the fixer 60, the jammed sheet S is not completely removed in the jam processing, and the sheet S remains in a gap between the fixing belt 61 and the temperature sensor 66, the sheet S becomes an obstacle to the temperature sensor 66, and the temperature sensor 66 detects a lower temperature than a detected temperature of a case where no sheet S remains. As a result, in "during standby" and "during printing" after jam recovery, the lighting control of the heater 60C is performed to adjust the low detected temperature to the target temperature. Therefore, the temperature of the fixing belt 61 rises to a higher temperature than the target temperature, and the surface temperature of the fixing belt 61 may not be able to be appropriately adjusted. It is assumed that the gap between the fixing belt 61 and the temperature sensor 66, where the sheet S remains, is not strictly interpreted, and the gap includes a position near the gap and at which the sheet S affects the detection of the temperature sensor 66. Hereinafter, the gap and the position near the gap are referred to as a position near the temperature sensor 66. In the case where the sheet S remains at the position near the temperature sensor 66, the temperature of the fixing belt 61 is raised to a temperature higher than the target temperature. Therefore, the lighting rate of the heater 60C becomes higher than the lighting rate of the heater 60C in the case where no sheet S remains.

In the present embodiment, the controller 100 functions as a lighting rate calculator, and a lighting rate acquirer and a determiner of the present invention.

The controller 100 calculates the lighting rate of the heater 60C (the central heater H1 and the end heater H2) at every predetermined time. The controller 100 causes the storage 72 to store the calculated lighting rate in association with the control state (during standby or during printing) of the fixer 60 and a warming state of the fixer 60. Here, the warming state of the fixer 60 is a temperature sensor ambient temperature (a temperature in a vicinity of the temperature sensor 66). The temperature sensor ambient temperature is detected by a temperature detector (not illustrated).

The controller 100 compares a first lighting rate of the heater 60C after jam recovery from the occurrence of a jam in the fixer 60 with a second lighting rate of the heater 60C before jam occurrence. The controller 100 determines whether a comparison result exceeds a predetermined value, and outputs a determination result. Here, the comparison result is expressed by a ratio of the first lighting rate to the second lighting rate. For example, the controller 100 causes the operation display 20 to display a determination result (for example, a remaining sheet message) in a case where the ratio of the first lighting rate to the second lighting rate exceeds a predetermined value (for example, 1.3). Note that the calculation of the lighting rate, comparison of the lighting rates, and output of the determination result performed for the heater 60C in the present embodiment refer to calculation of the lighting rate, comparison of the lighting rates, and output of the determination result performed for each of the central heater H1 and the end heater H2.

For example, since the target temperature of the fixing belt 61 during standby is lower than the target temperature of the fixing belt 61 during printing, the lighting rate of the heater 60C during standby is lower than the lighting rate of the heater 60C during printing. That is, in a case where the control states of the fixer 60 in the lighting rates to be compared are different, the lighting rates cannot be correctly compared. Further, the lighting rate of the heater 60C is affected by the warming state of the fixer 60. For example, the lighting rate of a case where the heater 60C is controlled and lighted so that the surface temperature of the fixing belt 61 becomes the target temperature in the warming state before warm up is higher than the lighting rate of a case where the heater 60C is controlled and lighted so that the surface temperature of the fixing belt 61 becomes the target temperature in the warming state after warm up. Therefore, in the present embodiment, when comparing the first lighting rate with the second lighting rate, the controller 100 compares the lighting rates in the same control state (during standby or during printing) of the fixer 60 and in the same warming state of the fixer 60.

Figure 6:
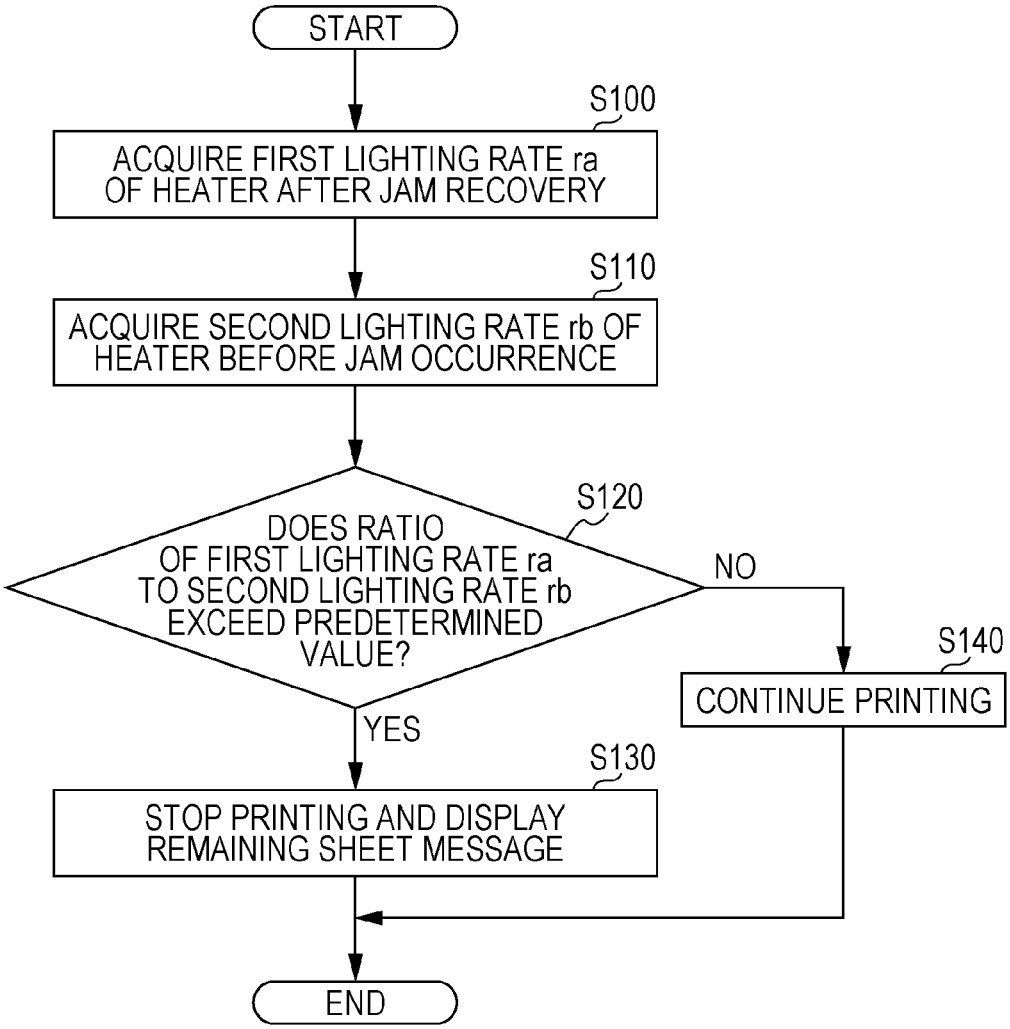
FIG. 6 is a flowchart illustrating processing of determining a lighting rate of a heater according to the present embodiment.

Next, processing of determining the lighting rate of the heater 60C in the present embodiment will be described with reference to FIG. 6. FIG. 6 is a flowchart illustrating processing of determining the lighting rate of the heater 60C. This processing is started when a jam occurs in the fixer 60. Note that the lighting rate of the heater 60C is calculated at every predetermined time by the controller 100 and is stored in the storage 72 in association with the control state of the fixer 60.

In step S100, the controller 100 acquires a first lighting rate ra of the heater 60C after jam recovery.

In step S110, the controller 100 acquires a second lighting rate rb of the heater 60C before jam occurrence.

In step S120, the controller 100 determines whether a ratio of the first lighting rate ra to the second lighting rate rb exceeds a predetermined value. In a case where the ratio of the first lighting rate ra to the second lighting rate rb exceeds the predetermined value (step S120: YES), the processing proceeds to step S130. In a case where the ratio of the first lighting rate ra to the second lighting rate rb is equal to or less than the predetermined value (step S120: NO), the processing proceeds to step S140.

In step S130, the controller 100 stops printing and causes the operation display 20 to display the remaining sheet message.

In step S140, the controller 100 continues printing.

According to the fixing device of the above embodiment, the heater 60C that is controlled and lighted on the basis of the detection result of the temperature sensor 66 is included, and the fixer 60 that melts and fixes the unfixed toner on the sheet S using the heat of when the heater 60C is lighted is included. In a case where a jam occurs at the fixing nip position of the fixer 60, the controller 100 acquires the first lighting rate of the heater 60C after jam recovery and the second lighting rate of the heater 60C before jam occurrence. Further, the controller 100 compares the first lighting rate with the second lighting rate, and determines whether the sheet S remains between the temperature sensor 66 and the heater 60C according to the comparison result. As a result, whether the sheet S remains after jam recovery can be accurately determined.

Next, a first modification of the present embodiment will be described with reference to FIG. 7. FIG. 7 is a diagram illustrating a correspondence between a temperature sensor ambient temperature and a correction coefficient of a lighting rate. In the above embodiment, the lighting rate of the heater 60C is affected by the warming state of the fixer 60, and thus the controller 100 compares the lighting rates in the same warming state of the fixer 60 in a case of comparing the first lighting rate with the second lighting rate.

In contrast, in the first modification, in a case where a first warming state of a fixer 60 associated with a first lighting rate and a second warming state of the fixer 60 associated with a second lighting rate to be compared with the first lighting rate are different, at least one of the first lighting rate and the second lighting rate is corrected on the basis of the correspondence between a temperature sensor ambient temperature and a correction coefficient of a lighting rate illustrated in FIG. 7. As illustrated in FIG. 7, the correction coefficient of the lighting rate with respect to the temperature sensor ambient temperature is "0.88" in a case where the temperature is less than 70° C. The correction coefficient is "0.92" in a case where the temperature is 70° C. or more and less than 90° C. The correction coefficient is "0.96" in a case where the temperature is 90° C. or more and less than 110° C. The correction coefficient is "1.00" in a case where the temperature is 110° C. or more.

In the case where the temperature sensor ambient temperature associated with the first lighting rate is 90° C. or more and less than 110° C., for example, the controller 100 corrects the first lighting rate by multiplying the first lighting rate by "0.96". Further, in the case where the temperature sensor ambient temperature associated with the second lighting rate is less than 70° C., for example, the controller 100 corrects the second lighting rate by multiplying the second lighting rate by "0.88". The controller 100 compares the first lighting rate with the second lighting rate after correction. In the first modification, it is not necessary to compare the lighting rates in the same warming state of the fixer 60. Therefore, whether a sheet S remains after jam recovery can be promptly determined.

Note that the correspondence between the temperature sensor ambient temperature and the correction coefficient of the lighting rate illustrated in FIG. 7 is based on the assumption that power density of a heat distributor of the central heater H1 and power density of a heat distributor of the end heater H2 are the same. In a case where the power density in the central heater H1 and the power density in the end heater H2 are different from each other, the correction coefficient of the lighting rate illustrated in FIG. 7 is just changed according to the power density.

Next, a second modification of the present embodiment will be described with reference to FIG. 8. FIG. 8 is a diagram illustrating a correspondence between a type of a sheet S and a correction coefficient of a lighting rate. FIG. 8 illustrates the basis weight in five stages in ascending order. The above embodiment has been described on the assumption that the type of the sheet S before jam occurrence and the type of the sheet S after jam recovery are the same. Incidentally, since the amount of heat absorbed by the sheet S varies depending on the basis weight of the sheet S, a detected temperature of a temperature sensor 66 is different even if a surface temperature of a heating roller 62 is the same. For example, since the detected temperature of the temperature sensor 66 becomes lower as the basis weight of the sheet S is larger, a lighting rate of a heater 60C becomes higher. Further, the amount of heat absorbed by a coated paper is larger than the amount of heat absorbed by a plain paper.

In the second modification, in a case where the type of the sheet S before jam occurrence and the type of the sheet S after jam recovery are different, a controller 100 corrects at least one of a first lighting rate and a second lighting rate on the basis of the correspondence between the type of the sheet S and the correction coefficient of the lighting rate illustrated in FIG. 8. As illustrated in FIG. 8, the correction coefficient of the lighting rate with respect to the type of the sheet S is "1.00" in a case of a plain paper of a basis weight 1. The correction coefficient is "1.20" in a case of a coated paper of the basis weight 1. The correction coefficient is "1.30" in a case of a plain paper of a basis weight 2. The correction coefficient is "1.56" in a case of a coated paper of the basis weight 2. The correction coefficient is "1.50" in a case of a plain paper of a basis weight 3. The correction coefficient is "1.80" in a case of a coated paper of the basis weight 3. The correction coefficient is "1.70" in a case of a plain paper of a basis weight 4. The correction coefficient is "2.04" in a case of a coated paper of the basis weight 4. The correction coefficient is "1.90" in a case of a plain paper of a basis weight 5. The correction coefficient is "2.28" in a case of a coated paper of the basis weight 5.

In a case where the type of the sheet S after jam recovery is the plain paper of the basis weight 2, for example, the controller 100 corrects the first lighting rate by dividing the first lighting rate by "1.30". Further, in a case where the type of the sheet S before jam occurrence is the coated paper of the basis weight 1, for example, the controller 100 corrects the second lighting rate by dividing the second lighting rate by "1.20". The controller 100 compares the first lighting rate with the second lighting rate after correction. In the second modification, whether the sheet S remains after jam recovery can be accurately determined even in a case where the type of the sheet S is different before and after jam occurrence.

Next, a third modification of the present embodiment will be described with reference to FIG. 9. FIG. 9 is a diagram illustrating a correspondence between a target temperature of a fixing belt 61 during standby and a correction coefficient of a lighting rate. FIG. 9 illustrates the target temperature in five stages in ascending order. The above embodiment has been described on the assumption that the target temperature of the fixing belt 61 is the same before jam occurrence and after jam recovery. By the way, in an actual apparatus, the target temperature of the fixing belt 61 may be different before jam occurrence and after jam recovery. For example, in a case where the target temperature of the fixing belt 61 is high, a difference between the target temperature and a detection result of a temperature sensor 66 becomes large, and thus the lighting rate becomes high. Correct comparison between a first lighting rate and a second lighting rate is difficult in a case where the target temperature of the fixing belt 61 is different before jam occurrence and after jam recovery. As a result, accurate determination as to whether the sheet S remains after jam recovery is difficult.

In contrast, in the third modification, in a case where the target temperature during standby of a fixer 60 associated with a first lighting rate and the target temperature during standby of the fixer 60 associated with a second lighting rate to be compared with the first lighting rate are different, a controller 100 corrects at least one of the first lighting rate and the second lighting rate on the basis of the correspondence between the target temperature of the fixing belt 61 during standby and the correction coefficient of the lighting rate. The correction coefficient of the lighting rate with respect to the target temperature during standby is "1.00" in a case of a target temperature 1. The correction coefficient is "1.15" in a case of a target temperature 2. The correction coefficient is "1.30" in a case of a target temperature 3. The correction coefficient is "1.45" in a case of a target temperature 4. The correction coefficient is "1.60" in a case of a target temperature 5.

For example, in a case where the target temperature during standby after jam recovery is the "target temperature 2", the controller 100 corrects the first lighting rate by dividing the first lighting rate by "1.15". Further, in a case where the target temperature during standby before jam occurrence is the "target temperature 3", the controller 100 corrects the second lighting rate by dividing the second lighting rate by "1.30". The controller 100 compares the first lighting rate with the second lighting rate after correction. In the third modification, whether the sheet S remains after jam recovery can be accurately determined even in a case where the target temperature is different before and after jam occurrence.

Next, a fourth modification of the present embodiment will be described. In the above embodiment, the calculation of the lighting rates, the comparison of the lighting rates, and the output of the determination results are performed for each of the central heater H1 and the end heater H2. For example, the controller 100 compares the first lighting rate of the central heater H1 with the second lighting rate of the central heater H1, and outputs the comparison result. Further, the controller 100 compares the first lighting rate of the end heater H2 with the second lighting rate of the end heater H2, and outputs the comparison result.

By the way, the central heater H1 warms the central part in the axial direction of the heating roller 62. Then, the central part in the axial direction of the heating roller 62 warms the central part in the axial direction of the fixing belt 61. Further, the end heater H2 warms the end part in the axial direction of the heating roller 62. Then, the end part in the axial direction of the heating roller 62 warm the end part in the axial direction of the fixing belt 61. If the sheet S remains in a gap between the end part in the axial direction of the fixing belt 61 and the temperature sensor 66, the temperature sensor 66 detects a lower surface temperature of the end part in the axial direction of the fixing belt 61 than an actual temperature, and thus the controller 100 determines that the difference between the surface temperature in the axial direction of the fixing belt 61 and the target temperature is larger than an actual difference. As a result, the lighting rate of the end heater H2 becomes higher than necessary. Meanwhile, the temperature sensor 66 correctly detects the surface temperature of the central part in the axial direction of the fixing belt 61, and thus the controller 100 correctly determines the difference between the surface temperature in the axial direction of the fixing belt 61 and the target temperature. As a result, the lighting rate of the central heater H1 does not become higher than necessary. That is, the remaining sheet after jam recovery can be determined by comparison of the lighting rate of the central heater H1 and the lighting rate of the end heater H2.

In the fourth modification, a controller 100 compares a lighting rate of a central heater H1 with a lighting rate of an end heater H2, determines whether a comparison result exceeds a predetermined value, and outputs a determination result. For example, in a case where a ratio of the lighting rate of the central heater H1 to the lighting rate of the end heater H2 is 0.75 or more and 1.3 or less, the controller 100 determines that there is no remaining sheet. Further, in a case where the ratio of the lighting rate of the central heater H1 to the lighting rate of the end heater H2 is less than 0.75, the controller 100 determines that the remaining sheet exists at a position near a temperature sensor 66 that detects a surface temperature of an end part in an axial direction of a fixing belt 61. The controller 100 causes an operation display 20 to display a determination result (for example, a remaining sheet message). Further, in a case where the ratio of the lighting rate of the central heater H1 to the lighting rate of the end heater H2 exceeds 1.3, the controller 100 determines that the remaining sheet exists at a position near the temperature sensor 66 that detects a surface temperature of a central part in the axial direction of the fixing belt 61. The controller 100 causes the operation display 20 to display a determination result (for example, a remaining sheet message).

Note that the lighting rate of the end heater H2 increases as the sheet width of the fed sheet becomes wider, the ratio of the lighting rate of the central heater H1 to the lighting rate of the end heater H2 becomes lower. Therefore, in the fourth modification, a determination criterion of the lighting rate ratio indicating the comparison result of the lighting rates to be compared with each other is changed according to the sheet width of the fed sheet. FIG. 10 is a diagram illustrating a correspondence between the sheet width and the determination criterion of the lighting rate ratio.

The controller 100 changes the determination criterion of the lighting rate ratio by reference to the correspondence between the sheet width and the determination criterion of the lighting rate ratio illustrated in FIG. 10 on the basis of the sheet width of the fed sheet. For example, in a case where the sheet width is less than 148 mm, the controller 100 changes the determination criterion of the lighting rate ratio to 2.0 or more and 3.5 or less. As illustrated in FIG. 10, the determination criterion of the lighting rate ratio to the sheet width is "2.0 to 3.5" in a case where the sheet width is less than 148 mm. The determination criterion is "1.3 to 2.2" in a case where the sheet width is 148 mm or more and less than 210 mm. The determination criterion is "1.1 to 1.9" in a case where the sheet width is 210 mm or more and less than 257 mm. The determination criterion is "0.9 to 1.55" in a case where the sheet width is 257 mm or more and less than 297 mm. The determination criterion is "0.75 to 1.3" in a case where the sheet width is 297 mm or more.

In the case where the determination criterion of the lighting rate ratio is 2.0 or more and 3.5 or less, the controller 100 determines that there is a remaining sheet and causes the operation display 20 to display a remaining sheet message in a case where the ratio of the lighting rate of the central heater H1 to the lighting rate of the end heater H2 is less than 2.0, or in a case where the ratio of the lighting rate of the central heater H1 to the lighting rate of the end heater H2 exceeds 3.5. Specifically, the controller 100 determines that the remaining sheet exists at the position near the temperature sensor 66 that detects the surface temperature of the end part in the axial direction of the fixing belt 61 in the case where the ratio of the lighting rate of the central heater H1 to the lighting rate of the end heater H2 is less than 2.0. Further, the controller 100 determines that the remaining sheet exists at the position near the temperature sensor 66 that detects the surface temperature of the central part in the axial direction of the fixing belt 61 in the case where the ratio of the lighting rate of the central heater H1 to the lighting rate of the end heater H2 exceeds 3.5.

Note that the fourth modification is based on the assumption that power density of a heat distributor of the central heater H1 and power density of a heat distributor of the end heater H2 are the same. In a case where the power density in the central heater H1 and the power density in the end heater H2 are different from each other, the determination criterion of the lighting rate ratio illustrated in FIG. 10 is just changed according to the power density.

Figure 11:
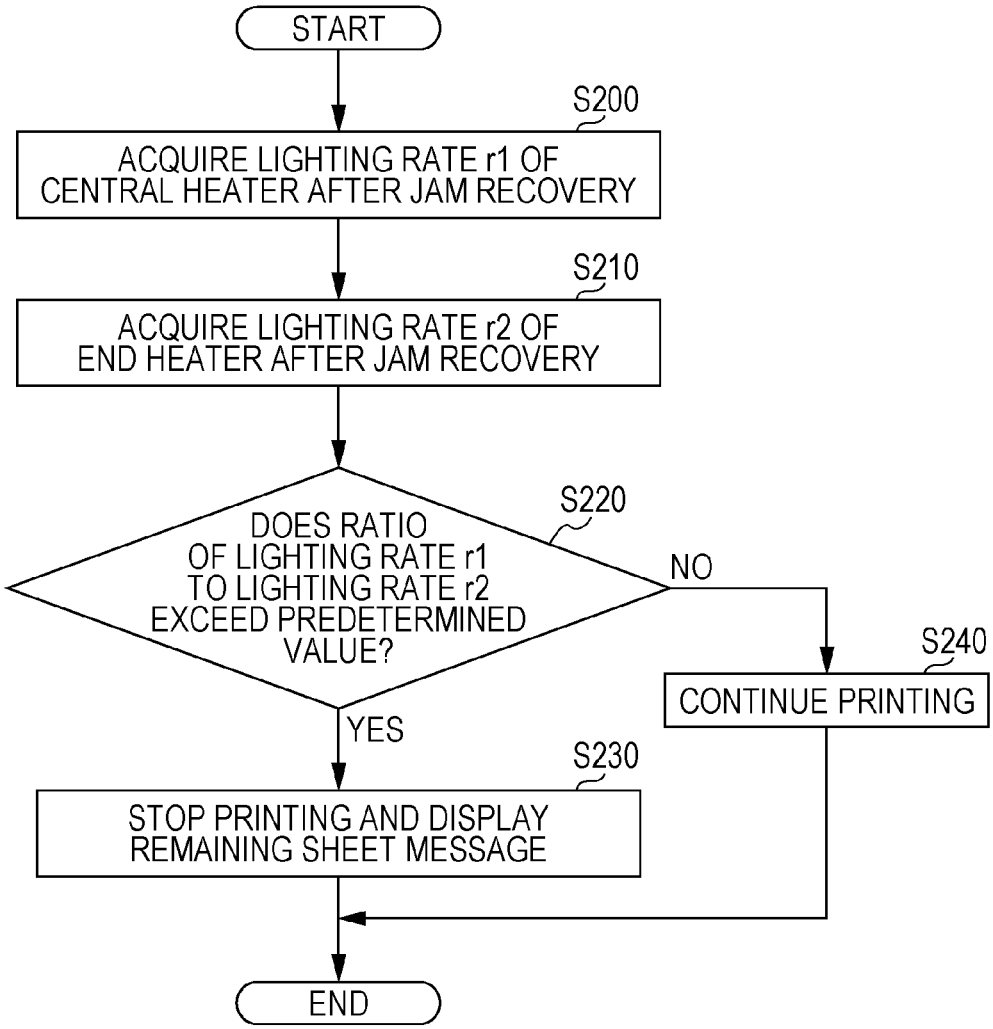
FIG. 11 is a flowchart illustrating processing of determining lighting rates of a central heater and an end heater according to the fourth modification.

Next, processing of determining the lighting rates in the central heater H1 and the end heater H2 according to the fourth modification will be described with reference to FIG. 11, FIG. 11 is a flowchart illustrating processing of determining the lighting rates of the central heater H1 and the end heater H2. This processing is started when a jam occurs in the fixer 60. Note that a lighting rate r1 of the central heater H1 and a lighting rate r2 of the end heater H2 are calculated at every predetermined time by the controller 100 and are stored in a storage 72.

In step S200, the controller 100 acquires the lighting rate r1 of the central heater H1 after jam recovery.

In step S210, the controller 100 acquires the lighting rate r2 of the end heater H2 after jam recovery.

In step S220, the controller 100 determines whether a ratio of the lighting rate r1 to the lighting rate r2 exceeds a predetermined value. In a case where the ratio of the lighting rate r1 to the lighting rate r2 exceeds a predetermined range (step S220: YES), the processing is moved onto step S230. In a case where the ratio of the lighting rate r1 to the lighting rate r2 falls within the predetermined range (step S220: NO), the processing is moved onto step S240.

In step S230, the controller 100 stops printing. Further, the controller 100 causes the operation display 20 to display a remaining sheet message.

In step S240, the controller 100 continues the printing.

According to the fourth modification, the remaining sheet after jam recovery can be accurately determined by performing comparison of the lighting rates in the axial direction. Note that the processing of determining the lighting rates in the fourth modification may be performed in place of the processing of determining the lighting rates in the above-described embodiment. Further, the processing of determining the lighting rates in the above-described embodiment and the processing of determining the lighting rates in the fourth modification may be combined. As a result, the remaining sheet after jam recovery can be more accurately determined.

Each of the above-described embodiments merely shows an example of implementation of the present invention, and the technical scope of the present invention should not be restrictively interpreted by the embodiment. That is, the present invention can be implemented in various forms without departing from the gist or the main characteristics of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. A fixing device comprising:

a fixer that includes a heater controlled and lighted on the basis of a detection result of a temperature sensor, and melts and fixes an unfixed toner on a recording medium, using heat of when the heater is lighted;

a lighting rate acquirer that acquires a first lighting rate of the heater after jam recovery and a second lighting rate of the heater before jam occurrence in a case where a jam of the recording medium occurs at a fixing nip position of the fixer; wherein the first lighting rate and the second lighting rate are measures of a lighting period of the heater in a control cycle; and a determiner that compares the first lighting rate with the second lighting rate, and determines whether the recording medium remains between the temperature sensor and the heater according to a result of the comparison.

2. The fixing device according to claim 1, wherein the lighting rate acquirer acquires the first and second lighting rates in association with a control state of the fixer.

3. The fixing device according to claim 2, wherein the control state of the fixer includes during standby and during printing.

4. The fixing device according to claim 3, wherein the determiner corrects at least one of the first and second lighting rates on the basis of a correspondence between the lighting rate and a target temperature in a case where a target temperature during standby of the fixer associated with the first lighting rate and a target temperature during standby of the fixer associated with the second lighting rate to be compared with the first lighting rate are different.

5. The fixing device according to claim 2, wherein the determiner compares the first lighting rate associated with the control state of the fixer with the second lighting rate associated with a same control state as the control state.

6. The fixing device according to claim 1, wherein the lighting rate acquirer acquires the first and second lighting rates in association with a warming state of the fixer.

7. The fixing device according to claim 6, wherein the determiner corrects at least one of the first and second lighting rates on the basis of a correspondence between the lighting rate and the warming state of the fixer in a case where a first warming state of the fixer associated with the first lighting rate and a second warming state of the fixer associated with the second lighting rate to be compared with the first lighting rate are different.

8. The fixing device according to claim 1, wherein the determiner corrects at least one of the first and second lighting rates on the basis of a correspondence between the lighting rate and a type of the recording medium in a case where a type of the recording medium before jam occurrence and a type of the recording medium after jam recovery are different.

9. The fixing device according to claim 1, wherein the heater has a plurality of regions divided in an axial direction, lighting in the plurality of regions is respectively provided corresponding to the plurality of regions and is controlled on the basis of a detection result of the temperature sensor, and the determiner compares the first lighting rates in the plurality regions with one another, and determines whether the recording medium remains between the temperature sensor and the heater according to a result of the comparison.

10. The fixing device according to claim 9, wherein the lighting rate acquirer acquires the first lighting rate after a lapse of a predetermined time from the jam recovery.

11. The fixing device according to claim 10, wherein the predetermined time is a time until a temperature of the heater rises to a predetermined temperature.

12. The fixing device according to claim 9, wherein the determiner changes a determination criterion of a lighting rate ratio indicating the comparison result of the first lighting rates compared with one another on the basis of a sheet passing width in the axial direction in the recording medium.

13. An image forming apparatus comprising the fixing device according to claim 1.

* * * * *